US006996350B2

(12) United States Patent
Tomizawa

(10) Patent No.: US 6,996,350 B2
(45) Date of Patent: Feb. 7, 2006

(54) IMAGE FORMING APPARATUS

(75) Inventor: Takeshi Tomizawa, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 10/607,309

(22) Filed: Jun. 27, 2003

(65) Prior Publication Data

US 2004/0005162 A1 Jan. 8, 2004

(30) Foreign Application Priority Data

Jul. 3, 2002 (JP) ..... 2002-194751
Jun. 6, 2003 (JP) ..... 2003-162431

(51) Int. Cl.
*G03G 15/16* (2006.01)
*G03G 15/00* (2006.01)

(52) U.S. Cl. ..... 399/66; 399/44; 399/45

(58) Field of Classification Search ..... 399/66, 399/44, 45

See application file for complete search history.

(56) References Cited

U.S. PATENT DOCUMENTS 4,977,430 A * 12/1990 Florack et al. ..... 399/314
5,450,180 A 9/1995 Ohzeki et al. ..... 355/274
6,029,022 A * 2/2000 Takase ..... 399/66
6,148,159 A * 11/2000 Shiraishi ..... 399/44
6,404,998 B1 6/2002 Tanaka et al. ..... 399/66
6,434,348 B1 8/2002 Tomizawa ..... 399/66
2002/0006294 A1 * 1/2002 Yano ..... 399/310

FOREIGN PATENT DOCUMENTS

JP 2-123385 5/1990
JP 5-1818373 7/1993
JP 7-49604 2/1995
JP 2000-75693 A 3/2000
JP 2001-109281 A 4/2001

* cited by examiner

*Primary Examiner*—Quana Grainger
(74) *Attorney, Agent, or Firm*—Fitzpatrick, Cella, Harper & Scinto

(57) ABSTRACT

An image forming apparatus including an image bearing body bearing an image, a transferring member being capable of contacting the image bearing body and transferring an image on the image bearing body to a transferring material when a voltage is applied thereto, and control portion for controlling the voltage applied to the transferring member, wherein the control portion determines the value of a reference voltage required for passing a current of a predetermined value appropriate to the type of transferring material through the transferring member contacting the image bearing body, and applies to the transferring member a transferring voltage of a value determined by adding to the reference voltage value an addition voltage value appropriate to the type of transferring material at the time when the image is transferred to the transferring material.

8 Claims, 9 Drawing Sheets

IMAGE FORMING APPARATUS

BACKGROUND OF THE INVENTION

1. Field of the Invention

The present invention relates to an image forming apparatus employing an electrophotography process or electrostatography process, and particularly to control of a transferring voltage applied to a transferring material when a developer image is transferred to the transferring material.

2. Related Background Art

Conventionally, in an image forming apparatus employing an electrophotography process or electrostatography process, a static latent image formed on an image bearing body is developed by a developer to form a developer image, followed by transferring the developer image on the image bearing body to a transferring material. When a toner image being the developer image is transferred onto the transferring material in this way, a transferring voltage is applied to the back surface of the transferring material to electrify the transferring material, and as means for electrifying the transferring material in this way, a corona electrifier, roller electrifier, brush electrifier, blade electrifier or the like is used.

However, the corona electrifier has problems such that ozone is emitted during electrification or static elimination, and a large amount of electric power is required, and therefore currently a conductive contact-type electrifier having the reduced amount of ozone emission and being capable of electrification with a small amount of electric power is often used.

For the conductive transferring member for use in this contact-type electrifier, a variety of shapes of members are available such as the roller-shaped member, the brush-shaped member and the blade-shaped member as described above, but the conductive member of the roller type is often chosen in terms of uniform electrification or static elimination and durability.

However, the roller-shaped transferring member is adjusted in resistance to keep the resistance within the middle resistance range by dispersing usually a conductive filler imparting conductivity such as carbon black or a metal oxide in a polymer elastomer material, but the uniformity of dispersion is not adequate from a production viewpoint, and circumferential resistance unevenness (hereinafter referred to as circumferential unevenness) occurs, resulting in a problem such that uniform electrification or static elimination is impossible.

As countermeasures against this circumferential unevenness, there have been increased cases where a transferring member having dispersed therein an ionically conductive polymer represented by, for example, a polymer with quaternary ammonium bases bound thereto and a block-type polymer having as a segment a polyethylene-epichlorohydrin copolymer or the like is employed.

However, even the transferring member having ionic conductivity has the following problems.

(1) The resistance changes significantly depending on environments (absolute water amount (weight of water contained in 1 kg of air)).

(2) The resistance increases if currents of same polarity are continuously applied.

(3) The resistance may decrease due to an increase in temperature within a main body even in the same environment, and transfer failure associated with the decrease in resistance may occur depending on the environment (absolute water amount (weight of water contained in 1 kg of air)) and the transferring material as a transfer object.

Methods for countering these problems and the like will now be described.

FIG. 10 shows the environmental change of resistance values for an tonically conductive polymer formed by blending nitrile rubber with an ethylene-epichlorohydrin copolymer and an electronically conductive polymer having carbon black dispersed in ethylene propylene rubber (EPDM), and as shown in this figure, the change of resistance values depending on the environment for the ionically conductive polymer is more significant than the electronically conductive polymer. Nevertheless, this problem can be countered by providing a set value for each environment (e.g. temperature, humidity and absolute water amount), namely adding environmental control.

An increase in resistance of the ionically conductive roller, i.e. the second problem can be countered by applying biases of both poles at predetermined intervals as disclosed in Japanese Patent Application Laid-Open No. 7-49604. However, this configuration has an effect of inhibiting an increase in resistance with duration, but has limitations in prolonging a life.

The third problem can be countered by ATVC control (Active Transfer Voltage Control) disclosed in Japanese Patent Application Laid-Open No. 2-123385. In this case, a target constant-current voltage is applied to a photosensitive drum from a transferring roller during a non-printing step in the image forming apparatus, the voltage value at this time is retained to detect the resistance of the transferring roller, and a constant voltage appropriate to the resistance value is applied to the transferring roller as a transferring voltage during a transfer process in a printing step, whereby the problem can be countered.

Another applied transferring voltage control is PTVC control (Programmable Transfer Voltage Control) as disclosed in Japanese Patent Application Laid-Open No. 5-181373.

Here, the resistance of the transferring roller is detected by constant current control in ATVC control, while in PTVC control, the resistance of the transferring roller is detected by constant voltage control alone, and therefore the circuitry is simplified and detection accuracy is improved. More specifically, a constant voltage is applied during detection of the resistance of the transferring roller, the value of an output current passing through the photosensitive drum is detected, and the voltage value is changed according to a difference between this current value and a set current value to determine a voltage accommodating the passage of a current of a target set value.

With these disclosed techniques alone, however, there have been cases where a proper transferring bias cannot be supplied when the resistance value of the transferring roller is considerably deviated from the normal resistance value.

Thus, Japanese Patent Application Laid-Open No. 2000-75693 discloses control for correcting a voltage determined by PTVC control. However, this publication does not disclose countermeasures as to the type of transfer object, the resistance change for the absolute water amount of the transfer object, and the resistance change for the absolute water amount of the transferring material.

In addition, for countermeasures for the transfer object, Japanese Patent Application Laid-Open No. 2001-109281 discloses a technique in which a set voltage of transferring voltage is determined from an impedance detected when the transfer object enters a transfer nip, but this technique requires control in an edge image marginal portion, and therefore makes it difficult to enhance a speed.

FIGS. 11A and 11B are schematic diagrams of a current distribution caused by the resistance of a transferring roller 9 being a roller-shaped transferring member of the conventional image forming apparatus, in which if the resistance of the transferring roller 9 is low and the resistance of a transferring material P is high, the back surface of the transferring material P is not given a sufficient amount of electric charge as shown in FIG. 11A, the back surface of the transferring material P having an image portion (toner portion) T is not give a sufficient amount of electric charge, and thus the back surface of the transferring material P of a non-image portion has greater electric charge density. Furthermore, reference numeral 1 in FIG. 11 denotes an image bearing body bearing a toner image T.

Thus, an increase in the borne amount per unit area of the toner portion T forming an image causes a "bursting" image in which the toner forming the upper layer is scattered due to a repulsive force of the toner in the lower layer and an attractive force of the electric charge on the back surface of the transferring material of the non-image portion.

If the resistance of the transferring roller 9 increases, however, the impedance of the transferring roller 9 becomes dominant in the entire system of the transferring portion including the impedances of the transferring material P and the toner, and as a result, transferring electric charges are uniformly supplied irrespective of existence/nonexistence of the transferring material P and existence/nonexistence of the image (toner) as shown in FIG. 11B, and therefore the "bursting" image described above tends to be prevented.

On the other hand, if the resistance of the transferring roller 9 is high, a dislocated image may occur due to an image of abnormal electric discharge in the upstream of the transfer nip particularly under a low-humidity environment (temperature: 23° C., humidity: 5%, absolute water amount: 0.86 g/kg). Therefore, the transferring voltage should be set to a level such that the latitude of the "bursting" image and the "dislocated image" can be secured.

In addition, the resistance of the transferring material P changes depending on the environment where the image forming apparatus is placed, particularly on the absolute water amount, and it is known that the above phenomena also vary depending on the type of transferring material P, and therefore the above problems can not be sufficiently solved with the prior art described in the example of the conventional technique.

It is apparent that if a conductive member having an ionically conductive polymer excellent in resistance stability particularly under a fixed environment and excellent in mass production resistance stability but poor in environmental resistance stability is employed for the transferring roller, countermeasures against the environmental change of resistance of the transferring roller are important, from the environmental change of resistance in FIG. 10 and the change of resistance in the main body shown in FIG. 5.

SUMMARY OF THE INVENTION

Thus, the present invention has been made in view of the current situation described above, and the object thereof is to provide an image forming apparatus capable of forming a satisfactory image without being influenced by the change of resistance of a transferring member, the environmental change of resistance of a transferring material and the like.

A preferred embodiment of the image forming apparatus for achieving the object described above is characterized by comprising:

an image bearing body bearing an image;

a transferring member being capable of contacting the image bearing body and transferring an image on the image bearing body to a transferring material when a voltage is applied thereto; and control means for controlling the voltage applied to the transferring member, wherein the control means determines the value of a reference voltage required for passing a current of a predetermined value appropriate to the type of transferring material through the transferring member contacting the image bearing body, and applies to the transferring member a transferring voltage of a value determined by adding to the reference voltage value an addition voltage value appropriate to the type of transferring material at the time when the image is transferred to the transferring material.

DESCRIPTION OF THE PREFERRED EMBODIMENTS

Embodiments of the present invention will be described in detail below with reference to the drawings.

Figure 1:
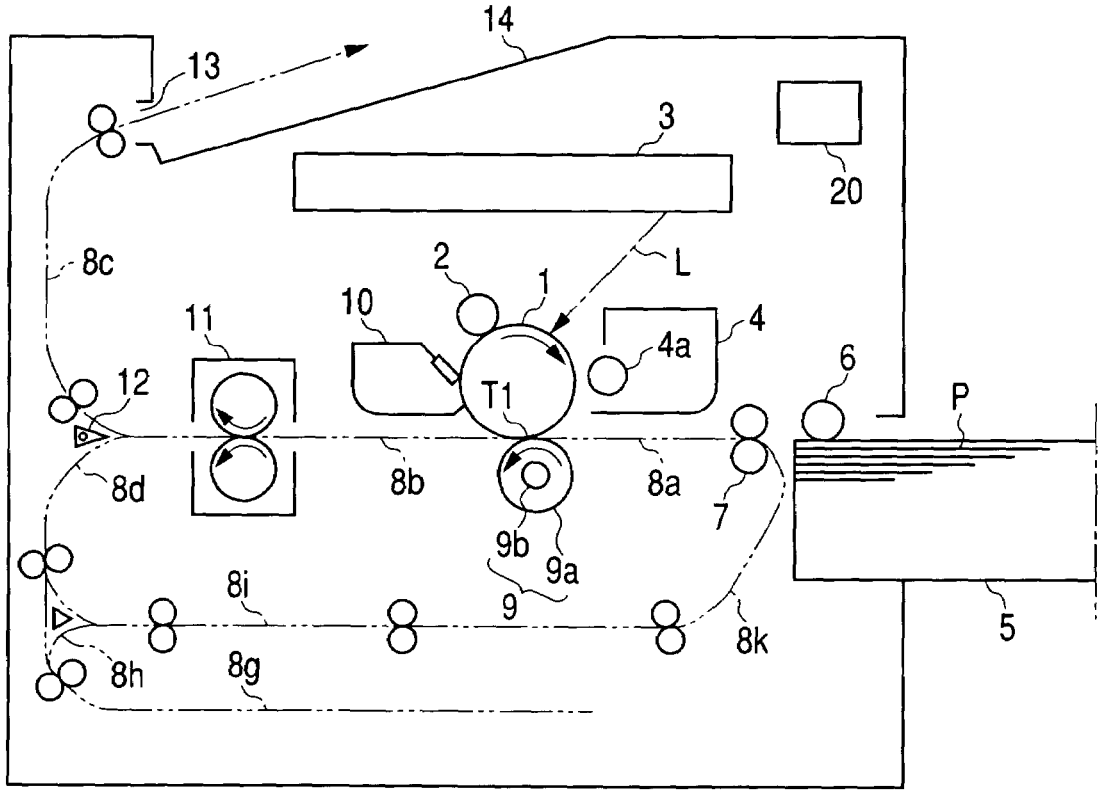
FIG. 1 shows an outlined configuration of an image forming apparatus according to the first embodiment.

FIG. 1 shows an outlined configuration of an image forming apparatus according to the first embodiment of the present invention, reference numeral 1 denotes a photosensitive drum being an image bearing body. Here, this photosensitive drum 1 is rotated in a clockwise direction at a predetermined circumferential speed (process speed) as shown by the arrow, and is electrified by electrification means 2 being a contact electrification member so that its circumferential surface has a predetermined polarity and potential (first electrification).

Reference numeral 3 denotes a laser beam scanner as image exposing means for outputting a laser beam L on/off-modulated according to image information inputted from an external apparatus such as an image scanner or computer (not shown) to scan-expose the electrified surface on the photosensitive drum 1, and a static latent image corresponding to desired image information is formed on the photosensitive drum 1 by the scan exposure by the laser beam scanner 3.

Reference numeral 4 denotes a developing apparatus developing the static latent image formed on the photosensitive drum 1, and the developing apparatus 4 supplies a developer (toner) onto the photosensitive drum 1 from a developing sleeve 4*a,* whereby the static latent image is developed and made visible as a toner image. Reference numeral 5 denotes a sheet feeding cassette 5 containing the transferring material P, and when a sheet feeding roller 6 is driven based on a sheet feeding start signal, the transferring material P in the sheet feeding cassette 5 is fed on a one-by-one basis.

Furthermore; the transferring material P fed by the sheet feeding roller 6 in this way is then conveyed to a registration roller 7, and is thereafter sent out by the registration roller 7 in predetermined timing. Consequently, the transferring material P is then introduced through a sheet pass 8*a* into a transferring site T1 being an abutting nip portion of the photosensitive drum 1 and the transferring roller 9 in timing synchronizing with timing in which the leading end portion of the toner image on the photosensitive drum 1 reaches the transferring site T1.

On the other hand, the transferring material P introduced in the transferring site T1 is conveyed with the transferring site T1 held between the transferring roller 9 and the photosensitive drum 1, and at this time, a transferring bias having a polarity opposite to that of the toner is applied from a transferring bias applying electric power source (not shown) to the transferring roller 9 as a contact rotation-type transferring member, whereby the toner image on the surface of the photosensitive drum 1 is static-transferred to the transferring material P at the transferring site T1. Control of the transferring bias in the present invention is performed by control means 20. The transferring roller 9 and the control of the transferring bias will be described later.

The transferring material P, to which the toner image is transferred at the transferring site T1 in this way, is then separated from the photosensitive drum 1 and conveyed, and is thereafter conveyed through a sheet pass 8*b* and introduced into a fixing apparatus 11, where the transferring material P is subjected to a heat and pressure fixing step. Furthermore, the surface of the photosensitive drum 1 after transfer and separation is cleaned to clean off a transfer residual toner, a sheet powder and the like by a cleaning apparatus 10, and is used again in the image forming step.

Then, after the toner image is fixed in this way, the transferring material P is passed through a sheet pass 8*c* and discharged to a sheet discharging portion 14 by a sheet discharging roller 13 if an image is formed on only one face. In addition, if an image is formed on a back face (second face), the transferring material P is conveyed through a sheet pass 8*d,* reversal passes 8*g* and 8*h* and re-conveyance passes 8*i* and 8*k* to the registration roller 7 by the switching of a flap 12, and thereafter the image is formed on the back face (second face).

In this embodiment, the transferring roller 9 is, for example, an ionically conductive sponge roller formed by blending nitrile rubber with an ethylene-epichlorohydrin copolymer, and the transferring roller 9 is constituted by a cored bar 9*b,* and a sponge rubber layer 9*a* fixed on the cored bar 9*b* having a NBR rubber reacted with a surfactant or the like so that the ratio of the minimum resistance value to the maximum resistance value along the circumference of the transferring roller (circumferential unevenness) is 1.5 or smaller, and the resistance value at a temperature of 23° C. and humidity of 50% is $1\times10^6$ to $1\times10^9$ Ω (applied voltage 2 kV).

Figure 2:
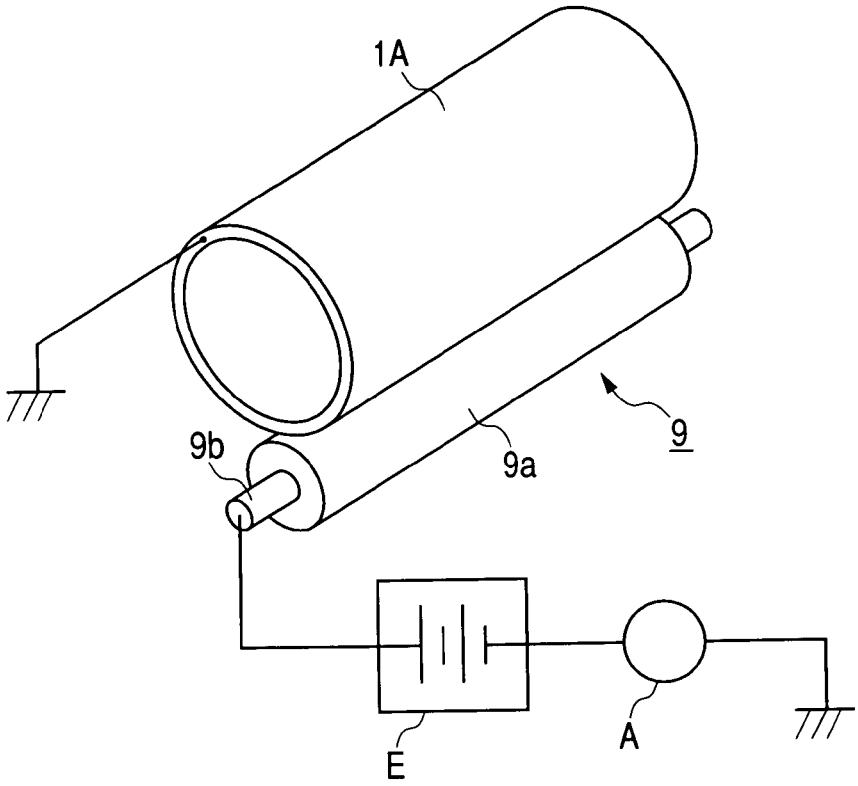
FIG. 2 is a schematic diagram illustrating a resistance measuring apparatus for measuring the resistance of a transferring roller provided in the image forming apparatus.

Furthermore, the resistance of the transferring roller 9 was measured by a resistance measuring apparatus shown in FIG. 2. Specifically, the transferring roller 9 was pressed against a rotated and driven aluminum drum (measuring body) 1A with the outer diameter of 30 mm under an abutting pressure of 9.8 N by applying a load of 4.9 N of each of cored bars at both ends to rotate them in an interlocked manner, a voltage of 2.0 kV was applied to between the cored bar 9*b* and the ground by a bias applied electric power source E, and the current passing through the aluminum drum 1A was measured by ammeter A to determine the resistance. In the above measurement, the current value was sampled each time when the transferring roller 9 was rotated in one turn or greater, and the roller resistance was calculated from the average of the sampled values.

Provided that the maximum value and the minimum value of the sampled current values is IMAX and IMIN, respectively, in this embodiment, the transferring roller 9 with IMAX/IMIN≦1.5, namely the transferring roller 9 with the resistance unevenness (circumferential unevenness) equal to or less than 1.5 in the rotational direction is used as in the case of the example of prior art.

Control for determining the transferring bias applied to this transferring roller 9 when the toner image on the photosensitive drum 1 is transferred to the transferring material P will now be described.

Furthermore, if no-load rotation of the photosensitive drum 1 after the user presses a copy button or starts a printer operation until the image formation operation is actually performed is called pre-rotation, no-load rotation after the user presses the copy button and so on until transferring material P and the toner image formed on the photosensitive drum 1 reach the transferring site T1, in other words, no-load rotation with the transferring material P not lying between the photosensitive drum 1 and the transferring roller 9.

Figure 3:
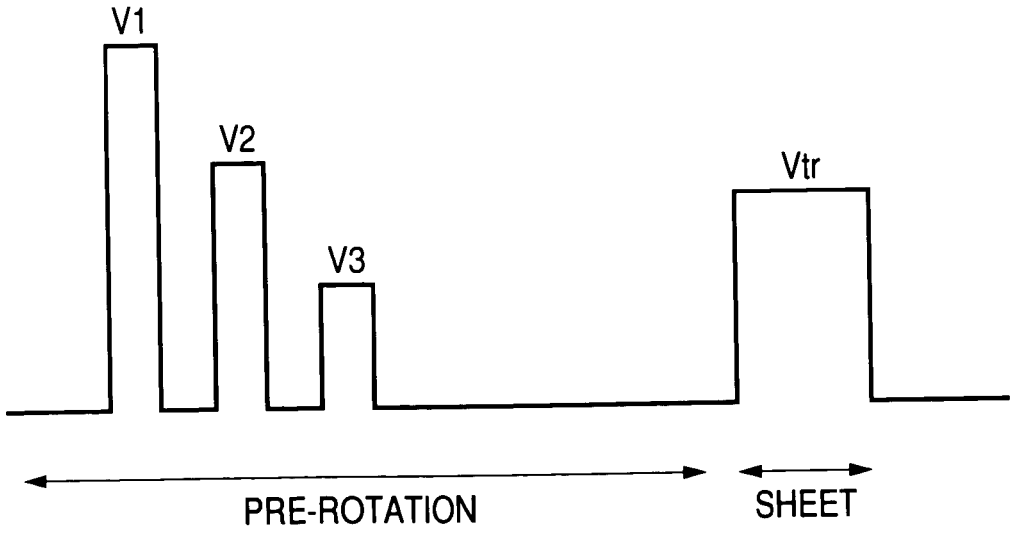
FIG. 3 is a schematic diagram of a sequence of pre-rotation determining the transferring voltage of the transferring roller.

First, the control means changes voltages in multiple stages during the pre-rotation, in other words, applies a plurality of different voltages on after another to detect a current for each voltage by current detecting means (not shown). In this embodiment, the voltage is changed in three stages (V1, V2, V3) as shown in FIG. 3, and a voltage-current characteristic (V-I characteristic), i.e. a relation between the applied voltage and the current value detected by the current detecting means is derived. Furthermore, sections other than measured points were lineally interpolated. In addition, V3<V2<V1 was assumed in this embodiment.

Figure 4:
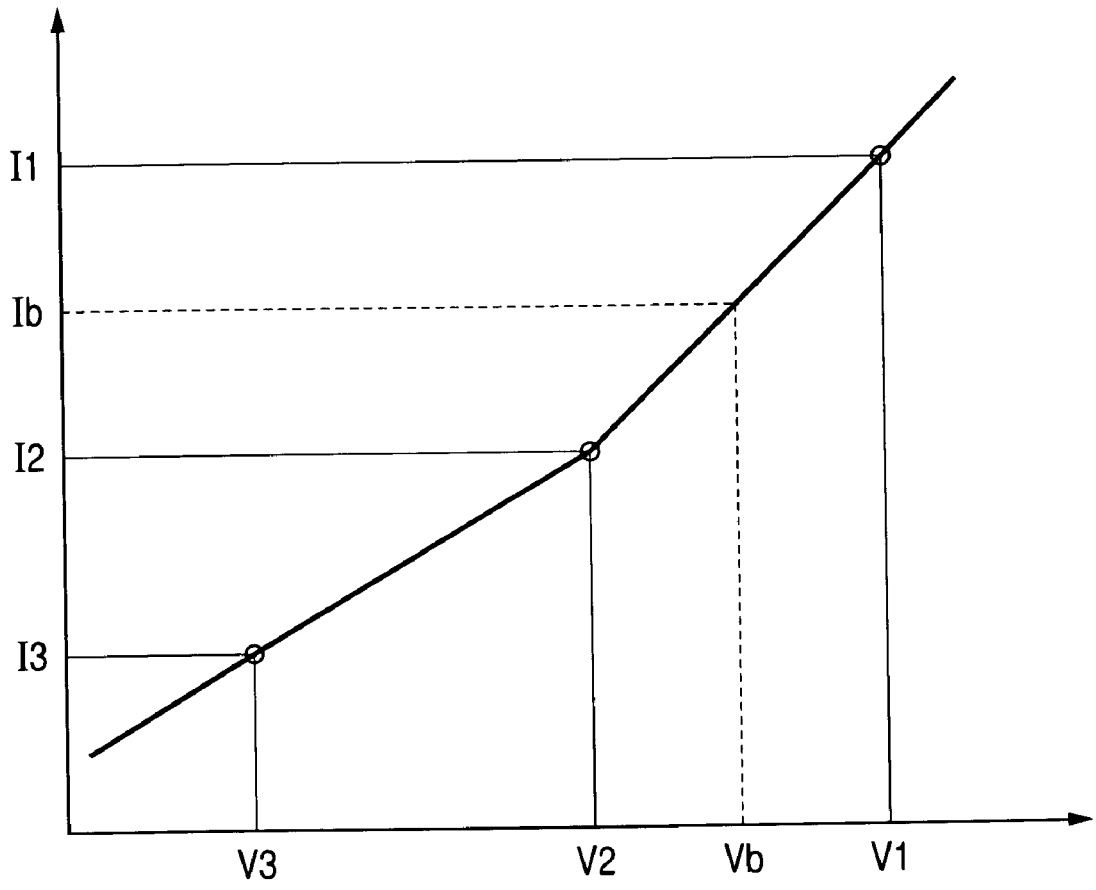
FIG. 4 shows the V-I characteristic of the transferring roller.

Then, a first voltage V1 is applied in an amount equivalent to one round of the transferring roller, the current value at this time is detected, and the averaged value is determined to be I1.Similarly, a current value I2 for a second voltage V2 and a current value I3 for a third voltage V3 are determined. FIG. 4 shows the V-I characteristic at this time.

Here, a required transferring current is determined in advance for each type of transferring material P, a reference voltage Vb required for passing this transferring current, which is applied to the transferring roller 9, can be determined from the V-I characteristic shown in FIG. 4.

Provided that the transferring current required for transferring the toner image on the photosensitive drum 1 to a certain transferring material P is Ib, for example, as shown in FIG. 4, the reference voltage can be determined from Vb=(V3−V2) (Ib−I2)/(I3−I2) +V2 if Ib≧I2 holds, and it can be determined from Vb=(V2−V1) (Ib−I1)/(I2−I1)+V1 if Ib<I2 holds.

Then, an addition voltage (value) Vp for the transferring material predetermined for each type of transferring material P (classified for each temperature and humidity environment) is added to the reference voltage (value) Vb determined in this way, whereby an actually applied transferring voltage (value) Vtr (=Vb+Vp) is outputted.

By using this method for determining a transferring voltage value, an appropriate transferring voltage for the characteristics of the transferring roller and the transferring material can be determined.

Here, when this type of control is employed, the reference voltage at a target current value of 24 μA was 1.8 kV when an image was formed on the paper recommended by our company (PB-SK Paper; basis weight of 64 g/m$^2$, manufactured by Nippon Paper Industries Co., Ltd.), for example, in a setting of transfer to the second face in automatic both faces in ordinary paper under a low-humidity environment (temperature: 23° C., humidity: 5%, absolute water amount: 0.86 g/kg), in the duration initial condition of the transferring roller 9 and immediately after the main body is started up.

A shared voltage of the transferring material P for this target current, namely an addition voltage value was 1.1 kV, a setting voltage was consequently 2.9 kV (=1.8+1.1), and satisfactory images including no defective images could be obtained as a result of transferring the toner image based on the setting voltage determined in this way.

Even if the transfer control described above is used, proper transfer conditions could not be obtained in some cases. An example of such a case will be described below.

On the other hand, when continuous formation of images on both faces or the like was continued, the reference voltage at the target current value of 24 μA was 1.0 kV because the temperature within the image forming apparatus gradually increased, and the resistance of the ionically conductive transferring roller 9 accordingly decreased. Here, the setting voltage would be 2.1 kV (=1.0+1.1) because the addition voltage value being the shared value of the transferring material P is 1.1 kV, but "bursting" images occurred at this voltage. Thus, when the addition voltage value was corrected by the correction formula (1) described later, and the addition voltage value was changed from 1.1 kV to 1.5 kV so that the setting voltage was 2.6 kV (=1.0+1.5), then the "bursting" images disappeared and satisfactory images could be obtained.

In addition, when control was performed in the same manner as described above for the transferring roller 9 after 200 thousands sheets of images were formed, the reference voltage value at the target current value of 24 μA was increased to 4.0 kV due to an increase in resistance with duration. Here, the setting voltage would be 5.1 kV (=4.0+1.1) because the shared voltage of the transferring material P (addition voltage value) is 1.1 kV, but "dislocated" images occurred due to abnormal electric discharge in the upstream of the transferring nip at the voltage of 5.1 kV.

Thus, when the addition voltage value was corrected by the correction formula (1) described later, and the addition voltage value was changed from 1.1 kV to 0.6 kV so that the setting voltage was 4.6 kV (=4.0+0.6), then the "dislocated" images disappeared and satisfactory images with no "bursting" images could be obtained.

In this way, by performing control for reducing the addition voltage value based on the transferring material P as the reference voltage increases, or increasing the addition voltage value based on the transferring material P as the reference voltage decreases, the setting of the transferring voltage can be optimized more reliably, and as a result, satisfactory images can be formed.

Specifically, for the second face in automatic both faces in ordinary paper under the low-humidity environment (temperature: 23° C., humidity: 5%, absolute water amount: 0.86 g/kg), the following correction (conversion) formula was employed:

$$\text{addition voltage value } Vp=-0.3\ Vb+1800 \quad (1)$$

In this formula, the addition voltage value is corrected by the value of reference voltage Vb. A linear function is used in this embodiment, but other functions may be used for optimization as a matter of course.

Similarly, under a high-humidity environment (temperature: 30° C., humidity: 80%, absolute water amount: 21.6 g/kg), the temperature within the main body increases, and thus the resistance value of the transferring roller 9 decreases particularly after continuous formation of images on both faces, in the early duration stage. In this case, when the toner image is transferred onto a transferring material of high resistance deprived of water by heat for fixation particularly in the second face in automatic both faces, the "bursting" image is most likely to occur.

In this case, however, satisfactory images could be obtained by using the following correction (conversion) formula for the addition voltage value based on the transferring material in the second face in automatic both faces under the high-humidity environment in the same manner as described above.

$$Vp=-0.6\ Vb+1680 \quad (2)$$

Table 1 correctively shows correction formulae of the addition voltage value Vp for first and second faces for the transferring voltage setting for the ordinary paper employed in this embodiment, and values of the tar-get current value Ib for first and second faces for each environment, i.e. high temperature and high humidity (H/H), ordinary temperature and ordinary humidity (N/N), and ordinary temperature and low humidity (N/L).

TABLE 1

| | Vp (addition voltage value) | | Ib (target current value) | |
|---|---|---|---|---|
| Environments | First face | Second face | First face | Second face |
| H/H | −0.5 Vb + 550 | −0.6 Vb + 1680 | 20 μA | 20 μA |
| N/N | −0.4 Vb + 850 | −0.5 Vb + 1720 | 20 μA | 20 μA |
| N/L | −0.3 Vb + 1500 | −0.3 Vb + 1800 | 20 μA | 24 μA |

By performing control employing correction formulae of the addition voltage value according to Table 1, image defects that would occur as the resistance of the transferring roller 9 changes due to an increase in temperature within the full-scale apparatus, and image defects resulting from the change of the resistance of the transferring roller 9 with duration can be prevented.

Furthermore, a determination on the environment is made using, for example, temperature and humidity sensors installed in the apparatus.

Table 2 collectively shows the results for the lowest resistance of the transferring roller (when the temperature within the main body in the early stage is high) and the highest resistance of the transferring roller (when the temperature within the main body after duration is low), before countermeasures are taken (the addition voltage is not corrected) and after countermeasures are taken (the addition voltage is corrected) in the case of the second face in automatic both faces in which the possibility of occurrence of defective images is particularly high, in formation of images on the ordinary paper. Furthermore, values in second and third rows from the left in Table 2 each represent a reference voltage value.

TABLE 2

| | Second face in automatic both faces | | | | | | | | | |
|---|---|---|---|---|---|---|---|---|---|---|
| | High temperature in early stage | | | | | | Low temperature after duration | | | |
| Environments | High temperature in early stage | Low temperature after duration | Addition voltage | Setting voltage | Bursting | Dislocated | Addition voltage | Setting voltage | Bursting | Dislocated |
| | Before measurements | | | | | | | | | |
| H/H | 300 | 1100 | 1100 | 1400 | X | ○ | 1100 | 2200 | ○ | ○ |
| N/N | 500 | 2200 | 1100 | 1600 | X | ○ | 1100 | 3300 | ○ | ○ |
| N/L | 1000 | 4000 | 1100 | 2100 | X | ○ | 1100 | 5100 | ○ | X |
| | After measurements | | | | | | | | | |
| H/H | 30 | 1100 | 1500 | 1800 | ○ | ○ | 1020 | 2120 | ○ | ○ |
| N/N | 500 | 2200 | 1470 | 1970 | ○ | ○ | 620 | 2820 | ○ | ○ |
| N/L | 1000 | 4000 | 1500 | 2500 | ○ | ○ | 600 | 4600 | ○ | ○ |

○: good
X: poor

Figure 5:
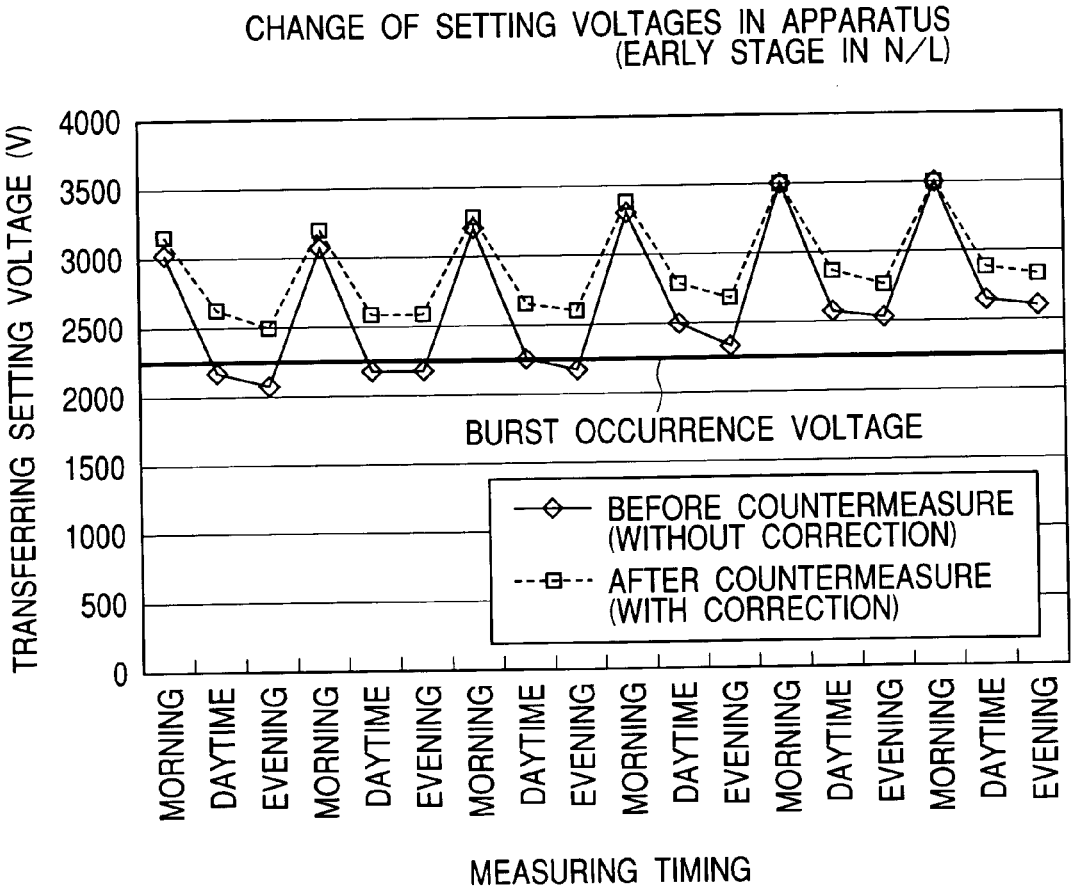
FIG. 5 shows the results of measuring the change of setting voltages in apparatus in the early stage in N/L of a setting voltage applied to the transferring roller.

According to Table 2, as shown in FIG. 5 showing the results of measuring the change of the setting voltage in the apparatus in the early stage in N/L in the morning, daytime and evening, for example, it can be understood that after countermeasures are taken, the decrease in reference voltage is covered by a high addition voltage value, and the increase in reference voltage is covered by a low addition voltage, whereby defective images are eliminated.

The target current value (Ib), the addition voltage value (Vp) and the correction formula of the addition voltage for ordinary paper have been described in Table 1, and for these values, different values are used depending on the type of transferring material. Tables 3 and 4 each show one example thereof.

TABLE 3

| Cardboard | | | | |
|---|---|---|---|---|
| | Vp (addition voltage value) | | Ib (target current value) | |
| Environments | First face | Second face | First face | Second face |
| H/H | −0.5 Vb + 250 | −0.6 Vb + 1350 | 10 μA | 12 μA |
| N/N | −0.4 Vb + 720 | −0.5 Vb + 2150 | 10 μA | 11 μA |
| N/L | −0.3 Vb + 1150 | −0.3 Vb + 2800 | 10 μA | 10 μA |

TABLE 4

| OHP | | | | |
|---|---|---|---|---|
| | Vp (addition voltage value) | | Ib (target current value) | |
| Environments | First face | Second face | First face | Second face |
| H/H | −0.5 Vb + 500 | — | 12 μA | — |
| N/N | −0.4 Vb + 950 | — | 10 μA | — |
| N/L | −0.3 Vb + 1200 | — | 8 μA | — |

Table 3 shows values in a cardboard (paper with the basis weight of 128 g/m$^2$ to 209 g/m$^2$), and Table 4 shows values in OHP (resin sheet formed by PET or the like). Values of Tables 3 and 4 are only examples, and these values are not limiting. In addition, other types of transferring materials may have unique values individually.

For information about the type of transferring material, the user may input such information to the image forming apparatus, or information detected by a transferring material type detecting sensor provided in the image forming apparatus may be used.

Figure 6:
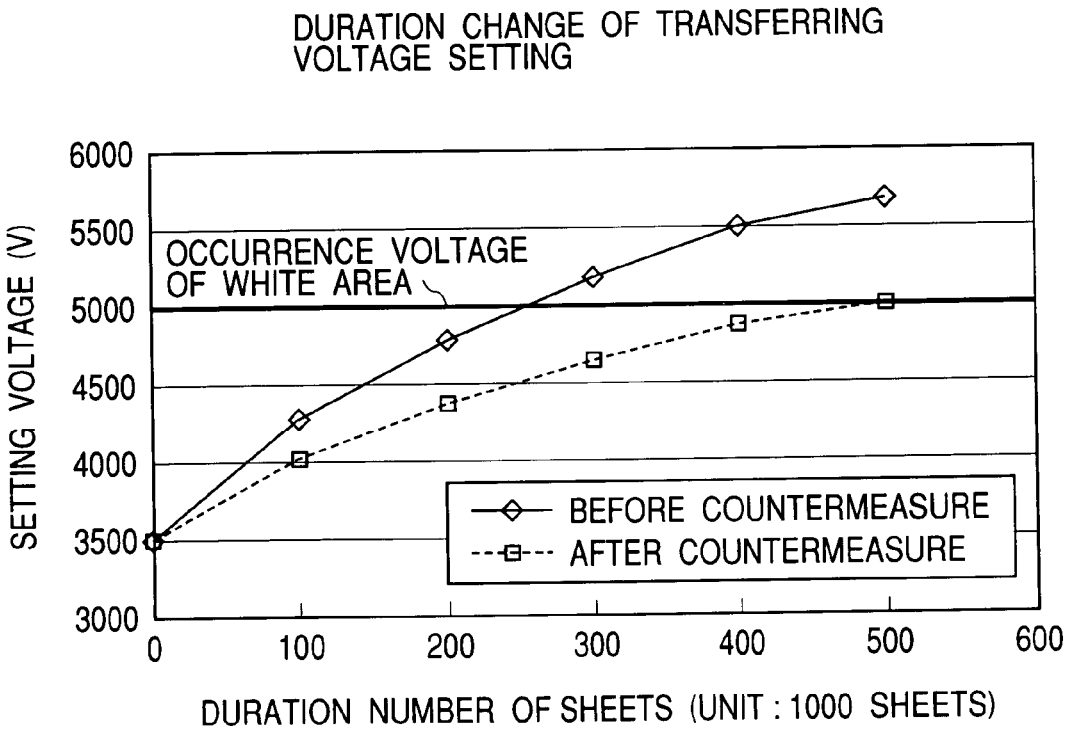
FIG. 6 shows a change with duration of the setting voltage applied to the transferring roller under a low-humidity environment.

FIG. 6 shows the change of the transferring voltage with duration under a low-humidity environment, and as apparent from this figure, dislocated images occur after about 250 thousands sheets of images are formed in the conventional method of setting the transferring voltage, and it has been considered that this is due to the life of the transferring roller 9. If the transferring bias is optimized by correction of this embodiment, however, the life of the transferring roller 9 can be prolonged to the level equivalent to about 500 thousands sheets.

In this way, by detecting the reference voltage value, and correcting the addition voltage value based on this reference voltage value or according to the environment condition and image forming modes at the time of pre-rotation before the image formation operation, for example, an optimum transferring bias can be supplied for the change of temperature within the main body and the change of resistance of the transferring roller 9 having an ionically conductive polymer changing with the duration number of sheets, whereby satisfactory images can be formed, and also the life of the transferring roller 9 can be prolonged.

Furthermore, the case has been described above where the voltage is changed in multiple stages in pre-rotation to determine the voltage-current characteristic, and the reference voltage appropriate to the target current value is calculates, but the present invention is not limited thereto, and for example, at the time of pre-rotation with the transferring material P not lying between the photosensitive drum 1 and the transferring roller 9, a predetermined target current determined in advance based on the type of transferring material P may be passed through the transferring roller 9, and also the value of a voltage applied to the transferring roller 9 at this time may be detected by voltage detecting means and used as the reference voltage value.

Furthermore, in this case, after the reference voltage value is determined in this way, control means corrects the addition voltage value based on the type of transferring material according to the reference voltage value, and adds the corrected addition voltage value to the reference voltage value. Consequently, the same effect as described above can be obtained.

There is an image forming apparatus in which the process speed of the image formation is changed depending on the type of transferring material P. For example, if ordinary paper (basis weight of 52 $g/m^2$ sheet to 128 $g/m^2$ sheet), cardboard (basis weight of more than 128 $g/m^2$ sheet to 209 $g/m^2$ sheet) and thickest cardboard (more than 209 $g/m^2$ sheet) are used, and the process speed of image formation for the ordinary paper is 1 in consideration of the fixation capacity, the speeds for the cardboard and the thickest cardboard are reduced to ½.

In this case, the same effect can be obtained by taking countermeasures described above.

Figure 7:
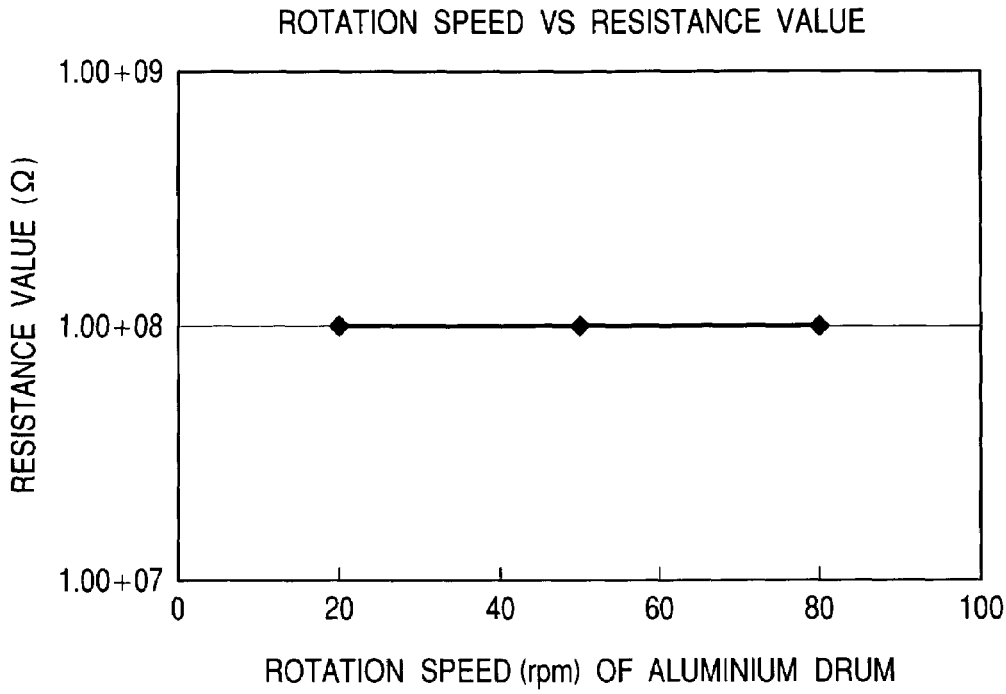
FIG. 7 shows a relation between the rotation speed of the transferring roller and the resistance value (impedance)
Figure 8:
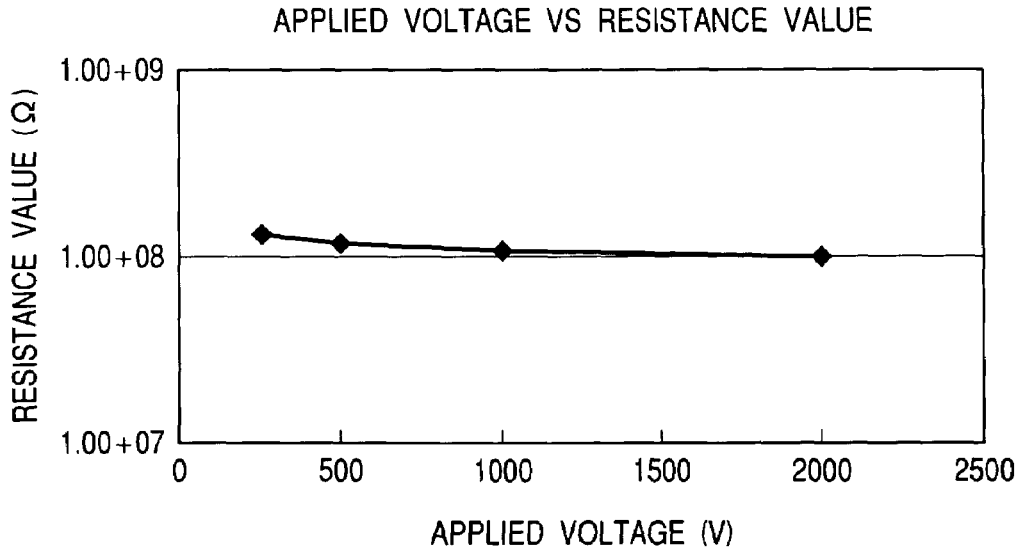
FIG. 8 shows a relation between the applied voltage of the transferring roller and the resistance value (impedance)

That is, since the density of electric charge supplied from the transferring roller 9 to the back surface of the transferring material is constant, the target transferring current is proportional to the speed. In addition, as shown in FIG. 7, the ionically conductive transferring roller 9 undergoes almost no change in impedance with the speed. Furthermore, the ionically conductive transferring roller 9 has almost no change of resistance with the applied voltage as shown in FIG. 8.

Therefore, if the target current value decreases by a factor of 2, then the reference voltage Vb decreases by a factor of 2. The addition voltage value is corrected for this reference voltage in the same manner as described above. Here, correction formulae for the second face in automatic both faces in which the possibility of occurrence of defective images is particularly high are shown in Table 5.

TABLE 5

| | Second face in automatic both faces | |
|---|---|---|
| | Cardboard | Thickest cardboard |
| H/H | −0.8 Vb + 1750 | −0.8 Vb + 1800 |
| N/N | −0.7 Vb + 2500 | −0.7 Vb + 2700 |
| N/L | −0.3 Vb + 3300 | −0.5 Vb + 3800 |

In this way, optimization of the transferring bias can be achieved by correcting the shared voltage of ordinary paper based on the reference voltage value according to the type of transferring material P. The case has been described where the image is formed on the ordinary paper at a speed of ½, but even if a different correction formula is similarly used for a different process speed with a different transferring material, the same effect can be obtained as a matter of course.

The second embodiment of the present invention will now be described.

Figure 9:
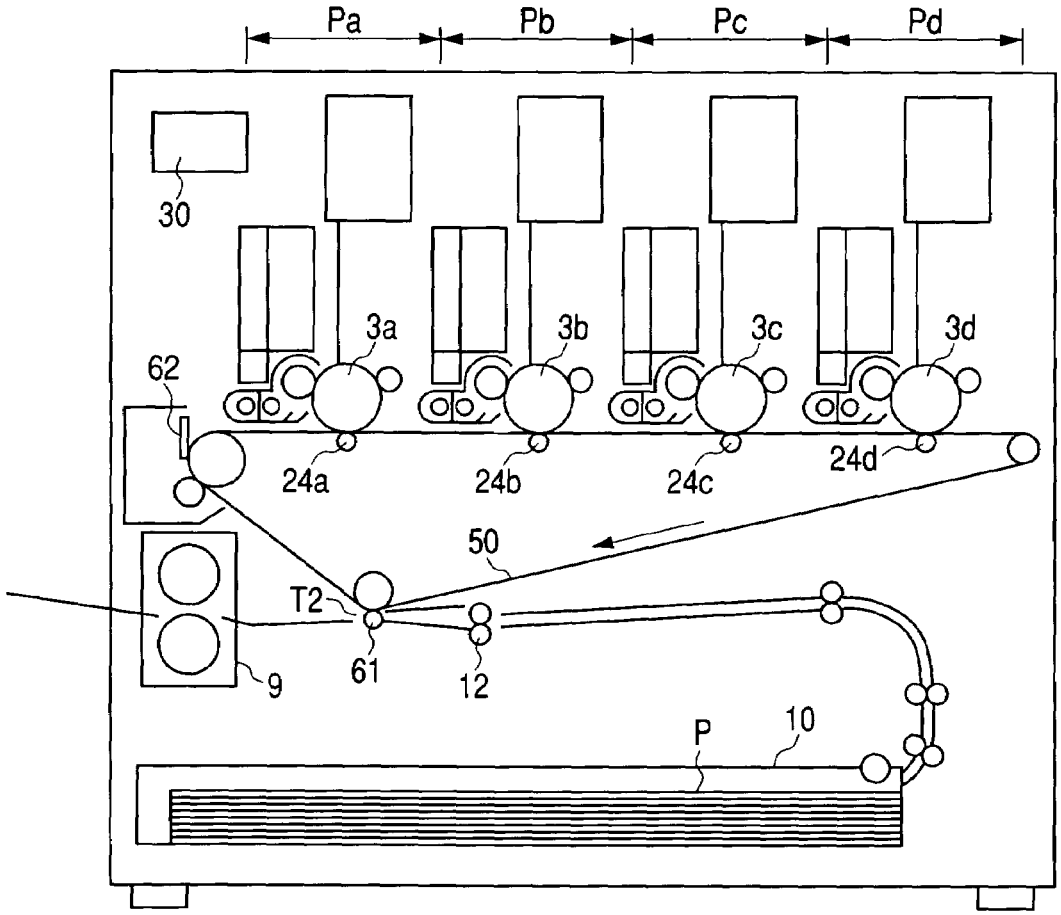
FIG. 9 shows an outlined configuration of an image forming apparatus according to the second embodiment.
Figure 10:
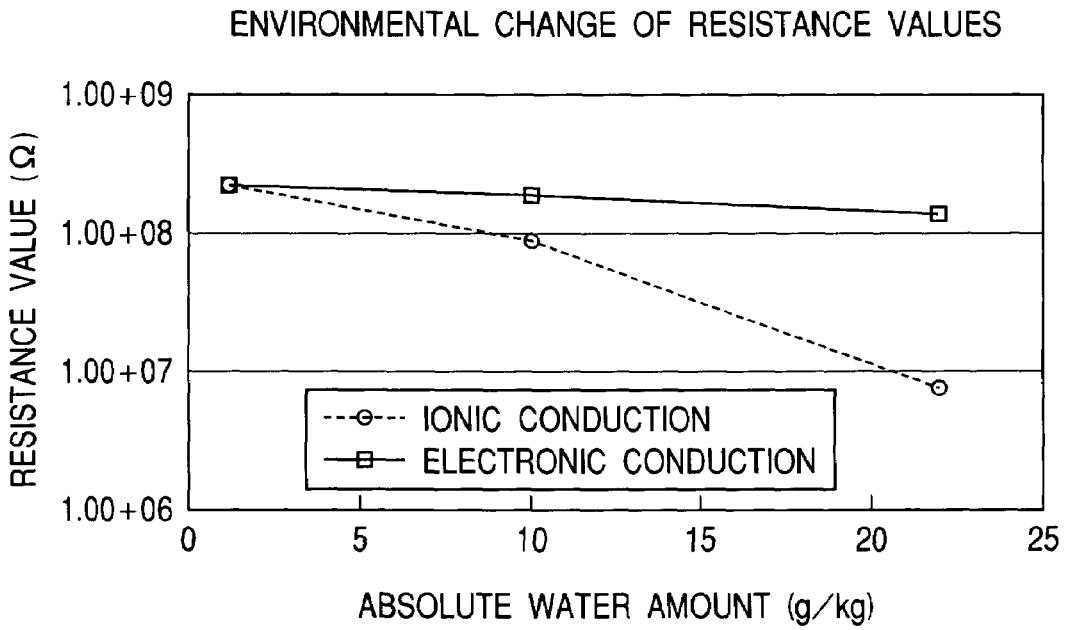
FIG. 10 shows the environmental change of resistance for a conventional ionically conductive polymer and an electronically conductive polymer.
Figure 11A:
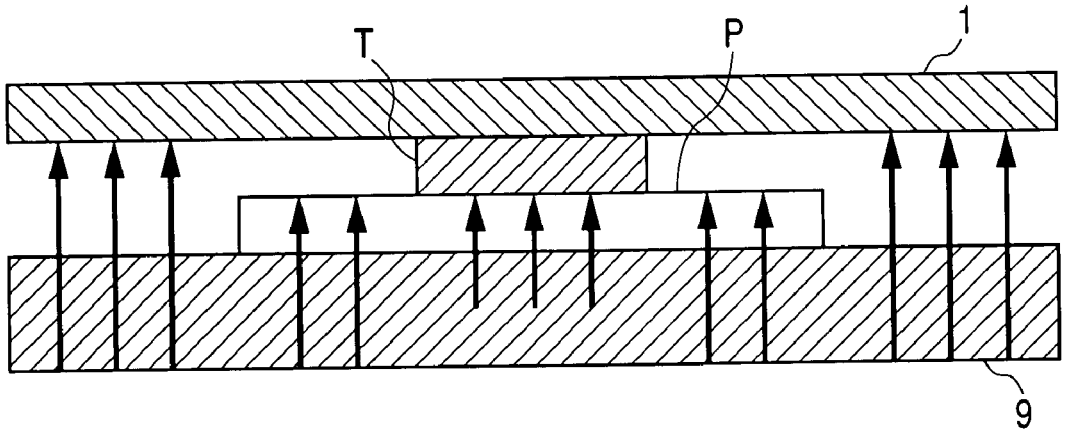
FIGS. 11A and 11B are schematic diagrams showing the conventional roller resistance and distribution of transferring current densities.
Figure 11B:
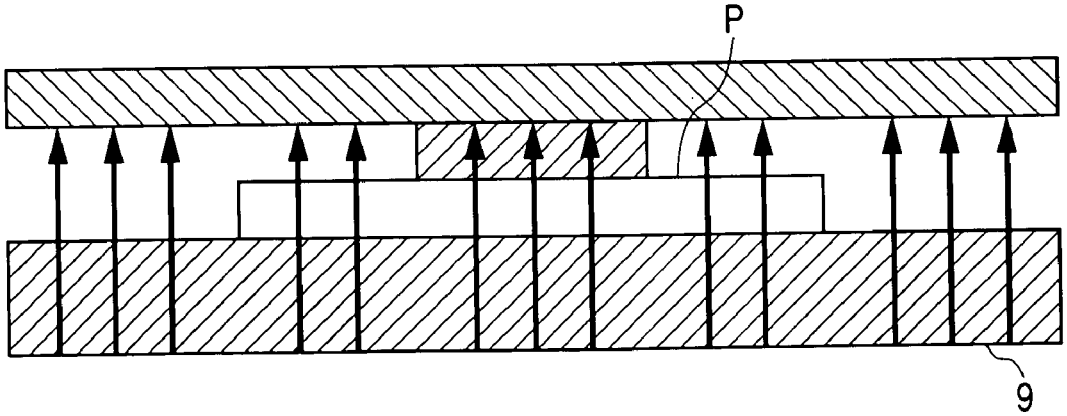

FIG. 9 shows an outlined configuration of an image forming apparatus according to this embodiment, the image forming apparatus has first to fourth image forming portions Pa to Pd placed side by side in its main body, toner images of different colors are formed through processes of latent image development, development and transfer in the image forming portions Pa to Pd.

Specifically, the image forming portions Pa to Pd comprise their own photosensitive drums 3*a* to 3*d,* respectively, toner images of different colors are formed on the photosensitive drums 3*a* to 3*d.* In addition, an intermediate transferring body 50 being a second image bearing body is placed in proximity to the photosensitive drums 3*a* to 3*d,* and a yellow toner image of first color on the photosensitive drum 3*a* is transferred to the intermediate transferring body 50 (first transfer) by a transferring bias applied to a first transferring roller 24*a* by a high-voltage electric power source (not shown).

Subsequently, in the same manner as described above, a second-color image, a third-color image and a fourth-color image, namely a magenta toner image, a cyan toner image and a black toner image are transferred onto the intermediate transferring body 50 in such a manner that they are superimposed one after another to obtain a color image with superimposed toner images of four colors.

Furthermore, the first transferring bias applied to first transferring rollers 24*a* to 24*d* in the embodiment is controlled by control means 30 for determining a desired first transferring voltage from the V-I characteristics in the same manner as the method of controlling the transferring bias described in the first embodiment.

The toner images of four colors formed on the intermediate transferring body 50 are fed from a transferring material cassette 10, and are transferred in a batch onto the transferring material P conveyed in timing therewith to a nip portion (second transferring portion) T2 of the intermediate transferring body 50 and a second transferring roller 61 by a registration roller 12 (second transfer).

The transferring bias is applied to the second transferring roller 61 by a high-voltage electric power source (not shown), whereby toner images of four colors are transferred in a batch to the transferring material P from the intermediate transferring body 50. The transferring voltage applied at this time is determined in the same manner as the case of the first transferring bias described above. Furthermore, the toner remaining on the intermediate transferring body 50 without being transferred through this second transfer is cleaned off by a cleaner 62 being intermediate transferring body cleaning means.

Here, the intermediate transferring body 50 is composed of a polyethylene terephthalate (PET) resin sheet, or a dielectric resin sheet such as a polyvinylidene fluoride resin sheet, polyurethane resin sheet or polyamide resin sheet, and an endless sheet with the both edges bonded together in such a manner that one edge is superimposed on another, or a (seamless) belt sheet having no seams is used.

Such an image forming apparatus has first transferring rollers 24*a* to 24*d* and a second transferring roller 61 as the transferring roller. This embodiment is characterized in that it is also applied to a second transferring bias applied to the second transferring roller 61 using the intermediate transferring body 50 as in the case of the first embodiment.

In this way, a conductive roller having ionic conductivity can effectively used as a transferring roller in the image forming apparatus having an intermediate transferring body capable of accommodating a variety of transferring materials employed in the current full color image forming apparatus.

What is claimed is:

1. An image forming apparatus comprising:

a moving image bearing member bearing an image;

a transferring member being capable of contacting said image bearing member and transferring an image on said image bearing member to a recording material when a transferring voltage is applied thereto; and detecting means which detects a relation between a current and a voltage when a monitor voltage or a monitor current is applied to said transferring member;

recording material information input means to which information concerning a type of said recording material is inputted;

correcting means which corrects a plurality of reference data corresponding to the type of the recording material in accordance with a detection result by said detecting means; and control means which variably controls said transferring voltage based on the information inputted to said recording material information input means, the reference data corrected by said correcting means, and the detection result of said detecting means.

2. The image forming apparatus comprising:

a moving image bearing member bearing an image;

a transferring member being capable of contacting said image bearing member and transferring an image on said image bearing member to a recording material when a transferring voltage is applied thereto; and detecting means which detects a relation between a current and a voltage when a monitor voltage or a monitor current is applied to said transferring member;

recording material information obtaining means which obtains information concerning a type of said recording material;

correcting means which corrects a plurality of reference data corresponding to the type of the recording material in accordance with a detection result by said detecting means; and control means which variably controls said transferring voltage based on the information obtained by said recording material information obtaining means, the reference data corrected by said correcting means, and the detection result of said detecting means.

3. The image forming apparatus according to claim 1 or 2, wherein said correcting means corrects the reference data according to an environment condition in which said apparatus is placed.

4. The image forming apparatus according to claim 3, wherein the environment condition is an absolute water content.

5. The image forming apparatus according to claim 1 or 2, wherein a moving speed of said image bearing body can be changed, and wherein said correcting means corrects the reference data according to the moving speed.

6. The image forming apparatus according to claim 1 or 2, wherein the image forming apparatus is capable of transferring an image to one face of the transferring material and thereafter transferring the image to the other face, and said correcting means corrects the reference data according to the face of the transferring material.

7. The image forming apparatus according to claim 1 or 2, wherein said transferring member has a roller shape, and provided that a maximum current in the circumferential direction is IMAX and a minimum current is IMIN when currents passing through said transferring member is measured while said transferring member is rotated with said transferring member being abutted against a measuring body, said transferring member satisfies the relation of:

$$IMAX/IMIN \leq 1.5.$$

8. The image forming apparatus according to claim 1 or 2, wherein said image bearing body is an intermediate transferring body to which an image from a different image bearing body is transferred.

* * * * *

UNITED STATES PATENT AND TRADEMARK OFFICE

CERTIFICATE OF CORRECTION

PATENT NO. : 6,996,350 B2
APPLICATION NO. : 10/607309
DATED : February 7, 2006
INVENTOR(S) : Takeshi Tomizawa It is certified that error appears in the above-identified patent and that said Letters Patent is hereby corrected as shown below:

ON THE COVER PAGE:

UNDER REFERENCES CITED, ITEM (56):

"5-1818373" should read --5-181373--.

IN THE DRAWINGS:

On Sheet 6, in Figure 7, "ALUMINIUM" should read --ALUMINUM--.

COLUMN 3:

Line 12, "give" should read --given--.

COLUMN 5:

Line 21, "Furthermore;" should read --Furthermore,--.

COLUMN 8:

Line 43, "tar-get" should read --target--.

COLUMN 11:

Line 8, "calculates," should read --calculated,--.

COLUMN 13:

Line 2, "used" should read --be used--.

UNITED STATES PATENT AND TRADEMARK OFFICE

CERTIFICATE OF CORRECTION

PATENT NO. : 6,996,350 B2
APPLICATION NO. : 10/607309
DATED : February 7, 2006
INVENTOR(S) : Takeshi Tomizawa It is certified that error appears in the above-identified patent and that said Letters Patent is hereby corrected as shown below:

COLUMN 14:

Line 32, "is" (first occurrence) should read --are--.

Signed and Sealed this

Twenty-second Day of August, 2006

JON W. DUDAS
*Director of the United States Patent and Trademark Office*